US006305196B1

(12) United States Patent
Takeshita et al.

(10) Patent No.: US 6,305,196 B1
(45) Date of Patent: Oct. 23, 2001

(54) SEAMLESS WARP KNITTED GOODS

(75) Inventors: Eiichi Takeshita; Yutaka Kitamaru, both of Kyoto (JP)

(73) Assignee: Hoei Sen-I Co., Ltd., Kyoto (JP)

( * ) Notice: Subject to any disclaimer, the term of this patent is extended or adjusted under 35 U.S.C. 154(b) by 0 days.

(21) Appl. No.: 09/463,332

(22) PCT Filed: Aug. 26, 1998

(86) PCT No.: PCT/JP98/03821

§ 371 Date: Jan. 21, 2000

§ 102(e) Date: Jan. 21, 2000

(87) PCT Pub. No.: WO99/11852

PCT Pub. Date: Mar. 11, 1999

(30) Foreign Application Priority Data

Sep. 2, 1997 (JP) ..... 9-237510

(51) Int. Cl.[7] ..... D04B 21/00
(52) U.S. Cl. ..... 66/195; 66/203
(58) Field of Search ..... 66/169 R, 120, 66/195, 203, 204, 84 R, 85 R; 442/304–312

(56) References Cited

U.S. PATENT DOCUMENTS 1,475,333 * 11/1923 Ward ..... 66/192
3,673,820 * 7/1972 Sarmiento ..... 66/177
3,685,319 * 8/1972 Jackson ..... 66/87
4,074,543 * 2/1978 Schmidt ..... 66/193
4,527,404 * 7/1985 Nakagaki et al. ..... 66/202
4,748,078 * 5/1988 Doi et al. ..... 442/312
5,172,570 * 12/1992 Wade et al. ..... 66/195

FOREIGN PATENT DOCUMENTS 872.297 3/1979 (BE) .
2-5176 6/1927 (JP) .
56-160918 11/1981 (JP) .
3024427 2/1996 (JP) .

OTHER PUBLICATIONS

Oct. 16, 2000 European Search Report for PCT/JP98/03821.
International Search Report dated Nov. 24, 1998.

* cited by examiner

*Primary Examiner*—Danny Worrell
(74) *Attorney, Agent, or Firm*—Merchant & Gould P.C.

(57) ABSTRACT

Seamless warp knitted goods comprising a sheet of continuous warp knitted goods wherein the fabric part and the lace part are integrally connected to each other along the direction of progress of the knitting stick, so that the sewed part between the fabric part and the lace part can be dispensed with and comfortable seamless warp knitted goods excellent in fashion and design are provided.

29 Claims, 7 Drawing Sheets

SEAMLESS WARP KNITTED GOODS

TECHNICAL FIELD

The present invention relates to a seamless warp knit fabric comprising a fabric portion (also referred to as a ground structure) and a lace portion that are integrally knitted.

BACKGROUND ART

In a conventional warp knit fabric, the fabric portion and the lace portion are separately knitted, for example, by using a raschel machine. Therefore, they are integrated exclusively by sewing, for example, when attaching the lace portion to the peripheral portion of the fabric portion of women's underwear (shorts, slips and the like), negligees, and the like.

In sewing, however, the sewn portion is necessarily thicker than the fabric portion and the lace portion. Therefore, such a warp knit fabric is not comfortable for wearing. Furthermore, the seam line protrudes outside, so that there are problems in fashion and design as well. In addition, in a conventional warp knitting machine, the knitting speeds of the fabric portion and the lace portion are different from each other because the densities of stitches of the fabric portion and the lace portion are different from each other. Therefore, the fabric portion and the lace portion cannot be knitted uniformly when trying to knit the fabric portion and the lace portion integrally.

DISCLOSURE OF INVENTION

In order to solve the above problems, it is an object of the present invention to provide a seamless warp knit fabric comprising a fabric portion and a lace portion that are integrally knitted so as to form one continuous warp knit fabric.

In order to achieve the purpose, a seamless warp knit fabric of the present invention comprises a continuous warp knit fabric comprising a fabric portion and a lace portion that are integrally knitted in the advance direction of stitches.

It is preferable that the width of the fabric portion is at least three times the width of the lace portion, because such a seamless warp knit fabric is suitable for using the fabric portion widely inside and locating the lace portion in an outside narrow portion when it is used for inner wear such as underwear.

It is preferable that a plurality of the lace portions are formed in the advance direction of stitches, because such a seamless warp knit fabric is suitable to use with left-right symmetric location when it is used for inner wear such as underwear.

It is preferable that the warp knit fabric is at least one knit fabric selected from the group consisting of a knit fabric using inelastic yarns (a rigid knit fabric), a knit fabric using elastic yarns in one direction (a one-direction stretchable knit fabric), and a knit fabric using elastic yarns in two directions (a two-direction stretchable knit fabric). The rigid knit fabric is useful for a blouse, a tablecloth, or the like. The one-direction or two-direction stretchable knit fabric is useful for inner wear such as underwear. Any one of the knit fabrics can be used for a negligee.

It is preferable that the yarn of the fabric portion is a covered yarn in which an elastic filament yarn is wound around an inelastic filament yarn, because such a seamless warp knit fabric is excellent in elasticity and touch. Any yarn can be used as the inelastic fiber yarn, for example, a synthetic filament yarn such as a nylon filament yarn or a polyester filament yarn, a spun yarn of synthetic staples such as nylon staples, polyester staples, or acrylic staples, a chemical fiber yarn such as a rayon yarn, a natural fiber yarn such as a cotton yarn, a linen yarn, a silk yarn, or a wool yarn, or a blended spun yarn such as polyester/cotton or rayon/cotton.

In addition, the fabric portion (the ground structure) may be a knit fabric selected from the group consisting of a solid-colored knit fabric and a knit fabric having a solid-colored pattern.

Furthermore, the fabric portion (the ground structure) may be a knit fabric selected from the group consisting of a single knitted structure and a double knitted structure. When the fabric portion (the ground structure) is a double knitted structure and such a seamless warp knit fabric is sewn for lingerie (underwear) such as shorts, slips, and the like, or negligees, the impression of being see-through is not provided. Therefore, a high-grade knit fabric can be provided. On the contrary, when the fabric portion (the ground structure) is a single knitted structure, the impression of being see-through can be provided.

It is preferable that the lace portion is a knit fabric selected from the group consisting of a knit fabric forming a pattern and a knit fabric forming a narrow lace portion.

Furthermore, an end of the seamless warp knit fabric can be formed by drawing a yarn from the knitted structure in at least one boundary between the lace portion and the fabric portion adjacent to the lace portion. Of course, the seamless warp knit fabric can be cut with scissors or a cutting machine. In addition, the end of the knit fabric may be linear or curved.

As described above, according to the present invention, the fabric portion and the lace portion are integrally knitted in the advance direction of stitches, so that the sewn portion between the fabric portion and the lace portion can be eliminated. Therefore, a warp knit fabric that is comfortable for wearing and is excellent in fashion and design without the protrusion of the seam line can be provided.

BEST MODE FOR CARRYING OUT THE INVENTION

The present invention will be described below in more detail by way of embodiments.

The warp knit fabric of the present invention can be implemented by using a raschel machine and at least four positive yarn feeders (for example, commercial products manufactured by KARL MAYER: EBA apparatuses) in the raschel machine. Since the densities of stitches of the fabric portion and the lace portion are different from each other, the yarn feed speeds are controlled by using at least four positive yarn feeders. Thus, the feed yarns can follow the different densities of stitches to make the knitting speeds of the fabric portion and the lace portion uniform. As a result, the fabric portion and the lace portion can be knitted uniformly and simultaneously, so that integral warp knitting can be implemented. While any number of the positive yarn feeders can be used as long as the number is at least four, it is preferable to use four to six positive yarn feeders in view of practical points and cost.

The present invention is further explained referring to drawings.

Figure 1:
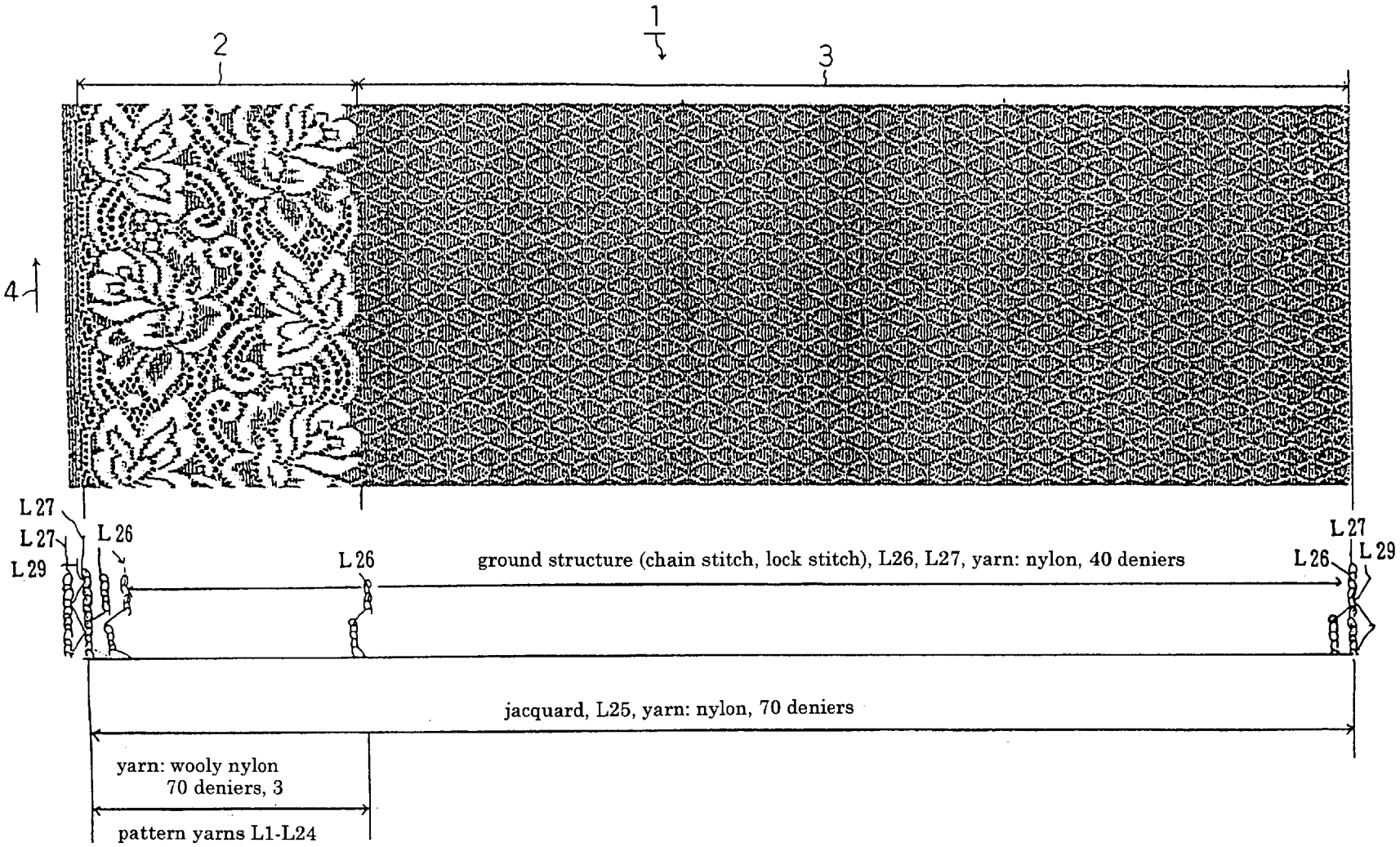
FIG. 1 is a view of the knitted structure of a knit fabric using inelastic yarns (a rigid knit fabric) in a first embodiment of the present invention.
Figure 2:
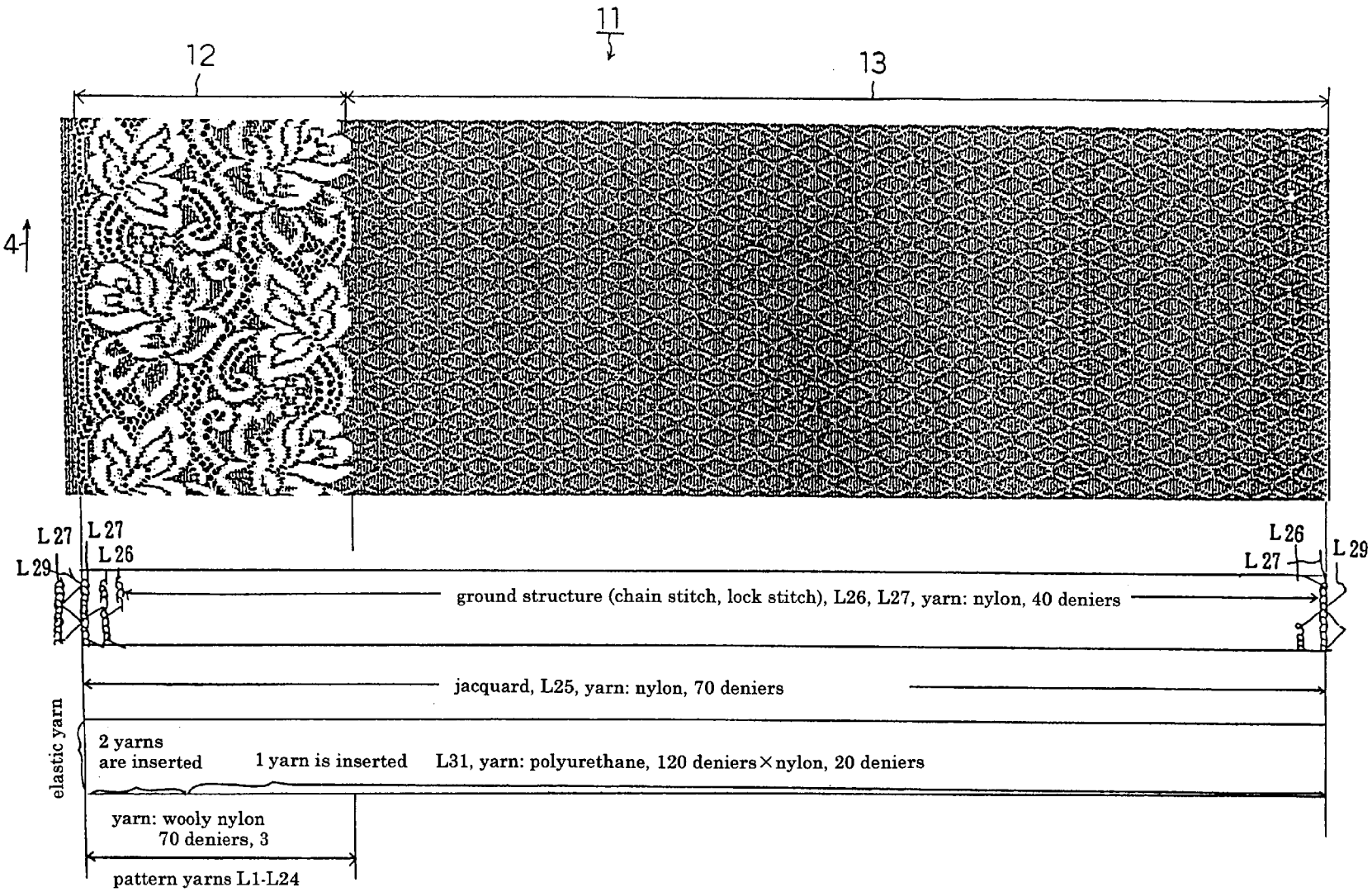
FIG. 2 is a view of the knitted structure of a knit fabric using elastic yarns in one direction (a one-direction stretchable knit fabric) in a second embodiment of the present invention.
Figure 3:
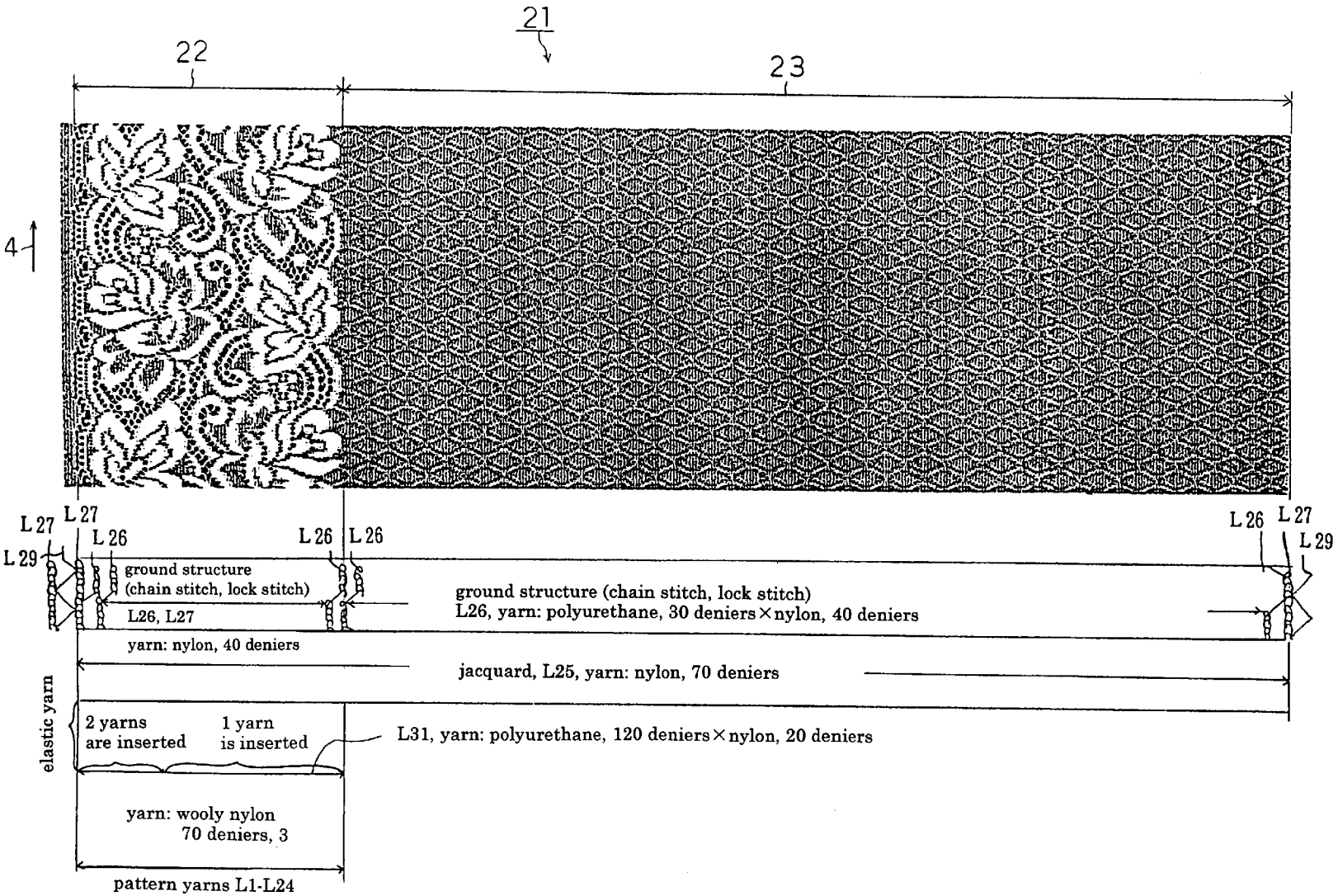
FIG. 3 is a view of the knitted structure of a knit fabric in which a fabric portion is two-direction stretchable and in which a lace portion is one-direction stretchable and stretches in the knitting direction in a third embodiment of the present invention.

FIG. 1 is a view of the knitted structure of a knit fabric using inelastic yarns (a rigid knit fabric). FIG. 2 is a view of the knitted structure of a knit fabric using elastic yarns in one direction (a one-direction stretchable knit fabric). FIG. 3 is a view of the knitted structure of a knit fabric in which a fabric portion is two-direction stretchable and in which a lace portion is one-direction stretchable and stretches in the knitting direction. In these views, reduced copies of actual warp knit fabrics are used and explanation is added.

FIG. 1 explains the knitted structure of a rigid knit fabric. In FIG. 1, 1 denotes one unit of a warp knit fabric, 2 denotes a narrow lace portion, 3 denotes a fabric portion, and 4 denotes a knitting direction. The width of the narrow lace portion 2 is, for example, 96 needles, and the width of the fabric portion 3 is, for example, 96 needles×3=288 needles. For example, a yarn in which three woolly finished yarns of nylon filaments (bulky yarns made by false twisting), the fineness: 70 deniers and the number of the filaments: 48, were twisted (a three twisted yarn) was used for the narrow lace portion ($L_1$–$L_{24}$) 2 as a pattern yarn. In addition, a nylon filament yarn (the fineness: 70 deniers and the number of the filaments: 48) was used as $L_{25}$ for jacquard for the whole narrow lace portion 2 and fabric portion 3. Furthermore, a nylon filament yarn (the fineness: 40 deniers and the number of the filaments: 34) was used as $L_{26}$ and $L_{27}$ for the ground structure (chain stitch and run-lock/lock stitch). A twisted yarn of two nylon filament yarns (the fineness: 70 deniers and the number of the filaments: 48) was used as $L_{29}$. The knit fabric was dyed after knitting, the drawn yarn $L_{29}$ was cut, and the fabrics were separated. Thus, a knit fabric as shown in FIG. 1 was obtained. In the knit fabric, the total width was 36 cm, the total length was 1 m, the width of the lace portion 2 was 8 cm, and the width of the fabric portion 3 was 28 cm. In addition, the weight of the lace portion 2 was 23 g (the basis weight was 287.5 g/m$^2$), the weight of the fabric portion 3 was 40 g (the basis weight was 142.9 g/m$^2$, and the total weight was 63 g (the basis weight was 175 g/m$^2$.

In the above, MRSEGF31/1/24 manufactured by KARL MAYER was used as the knitting machine. In a commercial product of this knitting machine, three positive yarn feeders (EBA apparatuses) were provided. The knitting machine was improved by increasing the number of the EBA apparatuses to four, and the yarns were fed to the lace portion and the fabric portion by using the EBA apparatuses. More specifically, uniform knitting was performed by using two EBA apparatuses for each of $L_{25}$ and $L_{26}$, four EBA apparatuses in total.

Second Embodiment

FIG. 2 explains the knitted structure of a one-direction stretchable knit fabric. Here, the one-direction stretchable knit fabric means a knit fabric that provides stretchability in a knitting direction 4 due to elastic yarns. In FIG. 2, 11 denotes one unit of a warp knit fabric, 12 denotes a narrow lace portion, and 13 denotes a fabric portion. The width of the narrow lace portion 12 is, for example, 96 needles, and the width of the fabric portion 13 is, for example, 96 needles×3=288 needles. For example, a yarn in which three woolly finished yarns of nylon filaments (bulky yarns made by false twisting), the fineness: 70 deniers and the number of the filaments: 48, were twisted (a three twisted yarn) was used for the narrow lace portion ($L_1$–$L_{24}$) 12 as a pattern yarn. In addition, a nylon filament yarn (the fineness: 70 deniers and the number of the filaments: 48) was used as $L_{25}$ for jacquard for the whole narrow lace portion 12 and fabric portion 13. Furthermore, a nylon filament yarn (the fineness: 40 deniers and the number of the filaments: 34) was used as $L_{26}$ and $L_{27}$ for the ground structure (chain stitch and lock stitch). Moreover, for about ⅓ of the narrow lace portion 12 on the left side, two covered yarns in which a nylon filament yarn (the fineness: 20 deniers and the number of the filaments: 7) was wound on the surface of a polyurethane filament (the fineness: 120 deniers) were inserted as $L_{31}$. From the right side of this portion to the whole fabric portion 13, one covered yarn in which a nylon filament yarn (the fineness: 20 deniers and the number of the filaments: 7) was wound on the surface of a polyurethane filament (the fineness: 120 deniers) was inserted as $L_{31}$. A twisted yarn of two nylon filament yarns (the fineness: 70 deniers and the number of the filaments: 48) was used as $L_{29}$. The knit fabric was dyed after knitting, the drawn yarn $L_{29}$ was cut, and the fabrics were separated. Thus, a knit fabric as shown in FIG. 2 was obtained. In the knit fabric, the total width was 36 cm, the total length was 1 m, the width of the lace portion 12 was 8 cm, and the width of the fabric portion 13 was 28 cm. In addition, the weight of the lace portion 12 was 23 g (the basis weight was 287.5 g/m$^2$), the weight of the fabric portion 13 was 40 g (the basis weight was 142.9 g/m$^2$, and the total weight was 63 g (the basis weight was 175 g/m$^2$).

In the above, MRSEGF31/1/24 manufactured by KARL MAYER was used as the knitting machine. In a commercial product of this knitting machine, three positive yarn feeders (EBA apparatuses) were provided. The knitting machine was improved by increasing the number of the EBA apparatuses to six, and the yarns were fed to the lace portion and the fabric portion by using the EBA apparatuses. More specifically, uniform knitting was performed by using two EBA apparatuses for each of $L_{26}$, $L_{26}$ and $L_{31}$, six EBA apparatuses in total.

Third Embodiment

FIG. 3 explains the knitted structure of a knit fabric in which a fabric portion is two-direction stretchable and a lace portion is one-direction stretchable and stretches in the knitting direction. Here, the two-direction stretchable fabric portion means a knit fabric that provides stretchability in two directions, that is, a knitting direction 4 and the direction perpendicular to the knitting direction 4, due to elastic yarns. In FIG. 3, 21 denotes one unit of a warp knit fabric, 22 denotes a narrow lace portion, and 23 denotes a fabric portion. The width of the narrow lace portion 22 is, for example, 96 needles, and the width of the fabric portion 23 is, for example, 96 needles×3 =288 needles. For example, a yarn in which three woolly finished yarns of nylon filaments (bulky yarns made by false twisting), the fineness: 70 deniers and the number of the filaments: 48, were twisted (a three twisted yarn) was used for the narrow lace portion ($L_1$–$L_{24}$) 22 as a pattern yarn. In addition, a nylon filament yarn (the fineness: 70 deniers and the number of the filaments: 48) was used as $L_{25}$ for jacquard for the whole narrow lace portion 22 and fabric portion 23. Furthermore, a nylon filament yarn (the fineness: 40 deniers and the number of the filaments: 34) was used as $L_{26}$ and $L_{27}$ for the ground structure of the narrow lace portion 22 (chain stitch and lock stitch). A covered yarn in which a nylon filament yarn (the fineness: 40 deniers and the number of the filaments: 34) was wound on the surface of a polyurethane yarn (the fineness: 30 deniers) was used as $L_{26}$ for the ground structure of the fabric portion 23 (chain stitch and lock stitch). Furthermore, for about ⅓ of the narrow lace portion 22 on the left side, two covered yarns in which a nylon filament yarn (the fineness: 20 deniers and the number of the filaments: 7) was wound on the surface of a polyurethane filament (the fineness: 120 deniers) were inserted as $L_{31}$. From the right side of this portion to the right end of the lace portion, one covered yarn in which a nylon filament yarn (the fineness: 20 deniers and the number of the filaments: 7) was wound on the surface of a polyurethane filament (the fineness: 120 deniers) was inserted as $L_{31}$. A twisted yarn of two nylon filament yarns (the fineness: 70 deniers and the number of the filaments: 48) was used as $L_{29}$. The knit fabric was dyed after knitting, the drawn yarn $L_{29}$ was cut, and the fabrics were separated. Thus, a knit fabric as shown in FIG. 3 was obtained. In the knit fabric, the total width was 36 cm, the total length was 1 m, the width of the lace portion 22 was 8 cm, and the width of the fabric portion 23 was 28 cm. In addition, the weight of the lace portion 22 was 23 g (the basis weight was 287.5 g/m$^2$), the weight of the fabric portion 23 was 40 g (the basis weight was 142.9 g/m$^2$, and the total weight was 63 g (the basis weight was 175 g/m$^2$).

In the above, MRSEGF31/1/24 manufactured by KARL MAYER was used as the knitting machine. In a commercial product of this knitting machine, three positive yarn feeders (EBA apparatuses) were provided. The knitting machine was improved by increasing the number of the EBA apparatuses to six, and the yarns were fed to the lace portion and the fabric portion by using the EBA apparatuses. More specifically, uniform knitting was performed by using two EBA apparatuses for each of $L_{25}$, $L_{26}$ and $L_{31}$, six EBA apparatuses in total.

Fourth Embodiment

Figure 4:
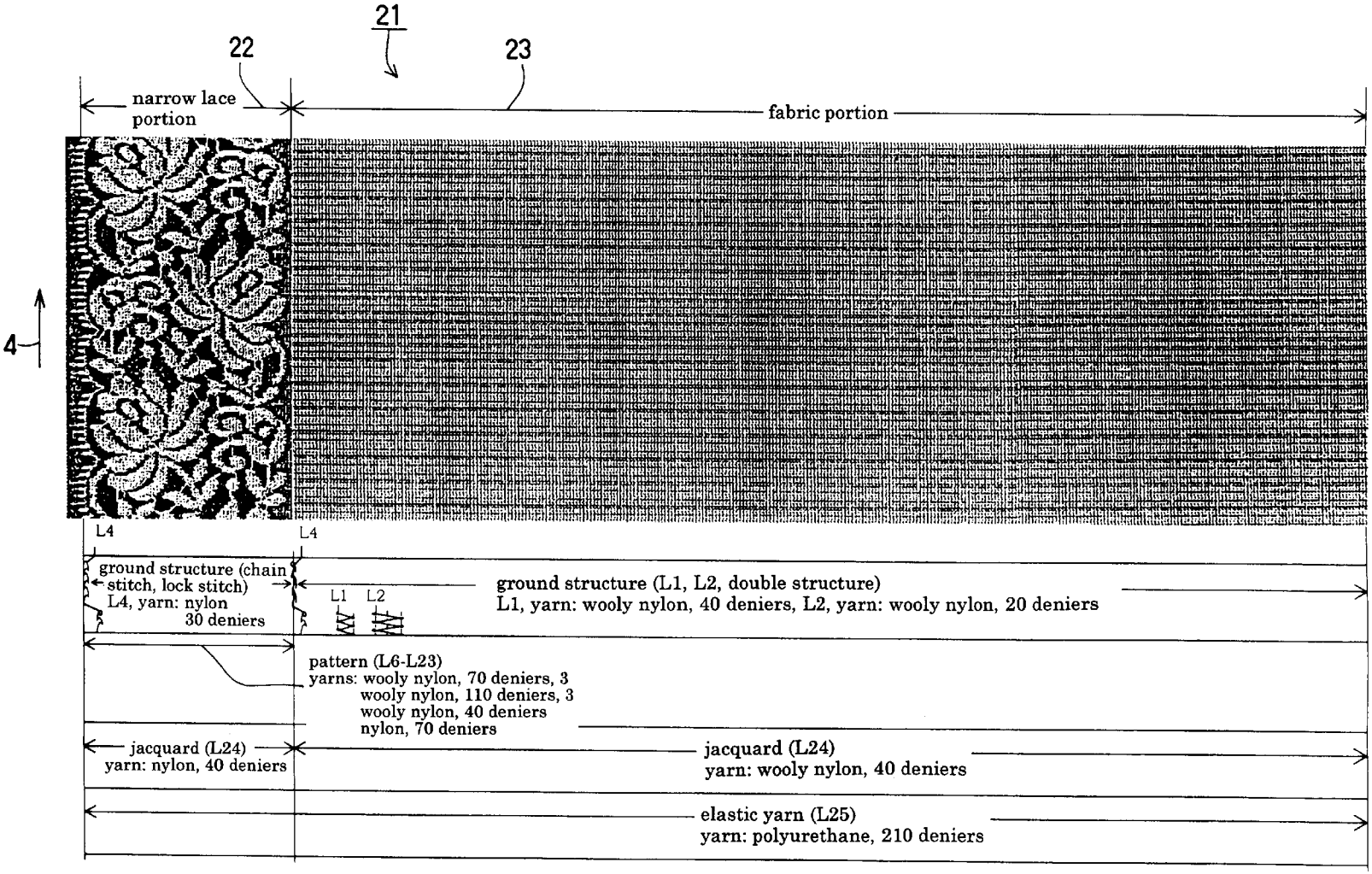
FIG. 4 is a view of the knitted structure of a knit fabric in which a fabric portion is two-direction stretchable and is a double knitted structure and in which a lace portion is one-direction stretchable and stretches in the knitting direction in a fourth embodiment of the present invention.

FIG. 4 explains the knitted structure of a knit fabric in which a fabric portion is two-direction stretchable and in which a lace portion is one-direction stretchable and stretches in the knitting direction. Here, the two-direction stretchable fabric portion means a knit fabric that provides stretchability in a knitting direction 4 due to elastic yarns and provides stretchability in the direction perpendicular to the knitting direction 4 due to yarns having stretchability and a knitted structure. In FIG. 4, 21 denotes one unit of a warp knit fabric, 22 denotes a narrow lace portion, and 23 denotes a fabric portion. The width of the narrow lace portion 22 is, for example, 72 needles. The width of the fabric portion 23 is, for example, 424 needles. For example, a yarn in which three woolly finished yarns of nylon filaments (bulky yarns made by false twisting), the fineness: 70 deniers and the number of the filaments: 48, were twisted (a three twisted yarn); a yarn in which three textured twist yarns or woolly finished yarns of nylon filaments (bulky yarns made by false twisting), the fineness: 110 deniers and the number of the filaments: 30, were twisted (a three twisted yarn); a woolly finished yarn of nylon filaments (bulky yarns made by false twisting), the fineness: 40 deniers and the number of the filaments: 34; and a nylon filament yarn, the fineness: 70 deniers and the number of the filaments: 48, were used for the narrow lace portion ($L_6$–$L_{23}$) 22 as pattern yarns. In addition, a nylon filament yarn (the fineness: 30 deniers and the number of the filaments: 6) was used as $L_4$ for the ground structure of the narrow lace portion 22 (chain stitch and lock stitch), a nylon filament yarn (the fineness: 40 deniers and the number of the filaments: 10) was used as $L_{24}$ for the net of the ground structure, and a polyurethane filament (the fineness: 210 deniers) was used as the elastic yarn $L_{25}$. Furthermore, a woolly finished yarn of nylon filaments (bulky yarns made by false twisting), the fineness: 40 deniers and the number of the filaments: 34, was used as the yarns $L_1$ and $L_{24}$ of the ground structure ($L_1$, $L_2$, $L_{24}$ and $L_{25}$) of the fabric portion 23, a woolly finished yarn of nylon filaments (bulky yarns made by false twisting), the fineness: 20 deniers and the number of the filaments: 7, was used as $L_2$, and a polyurethane filament (the fineness: 210 deniers) was used as $L_{25}$. The knit fabric was dyed after knitting, the outer portion of the picot yarn was cut, and the fabrics were separated. Thus, a knit fabric as shown in FIG. 4 was obtained. In the knit fabric, the total width was 35 cm, the total length was 50 m, the width of the lace portion 22 was 6 cm, and the width of the fabric portion 23 was 29 cm. In addition, the weight of the lace portion 22 was 9 g (the basis weight was 112.5 g/m$^2$, the weight of the fabric portion 23 was 56 g (the basis weight was 198.8 g/m$^2$), and the total weight was 65 g (the basis weight was 180.5 g/m$^2$).

Description of the Structure of the Fabric Portion

Figure 5:
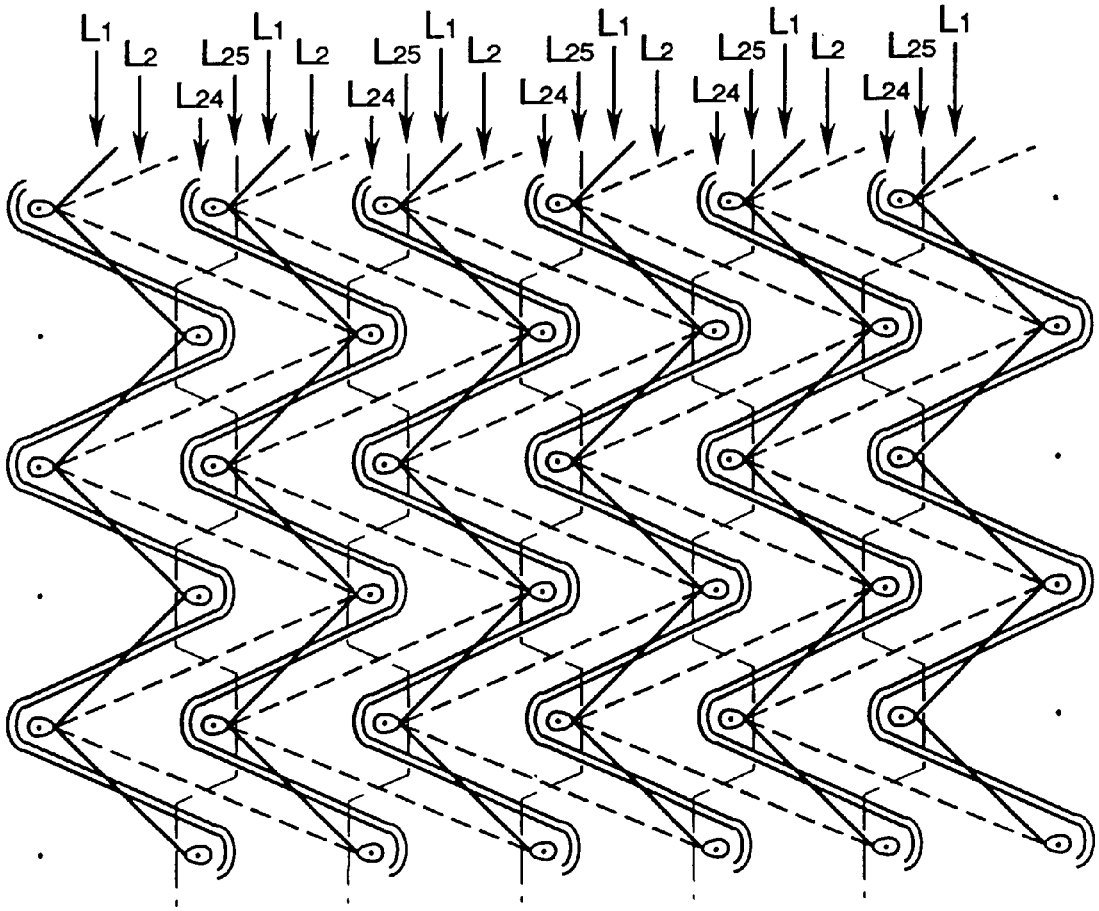
FIG. 5 schematically shows the knitting data of the fabric portion in the fourth embodiment.
Figure 6:
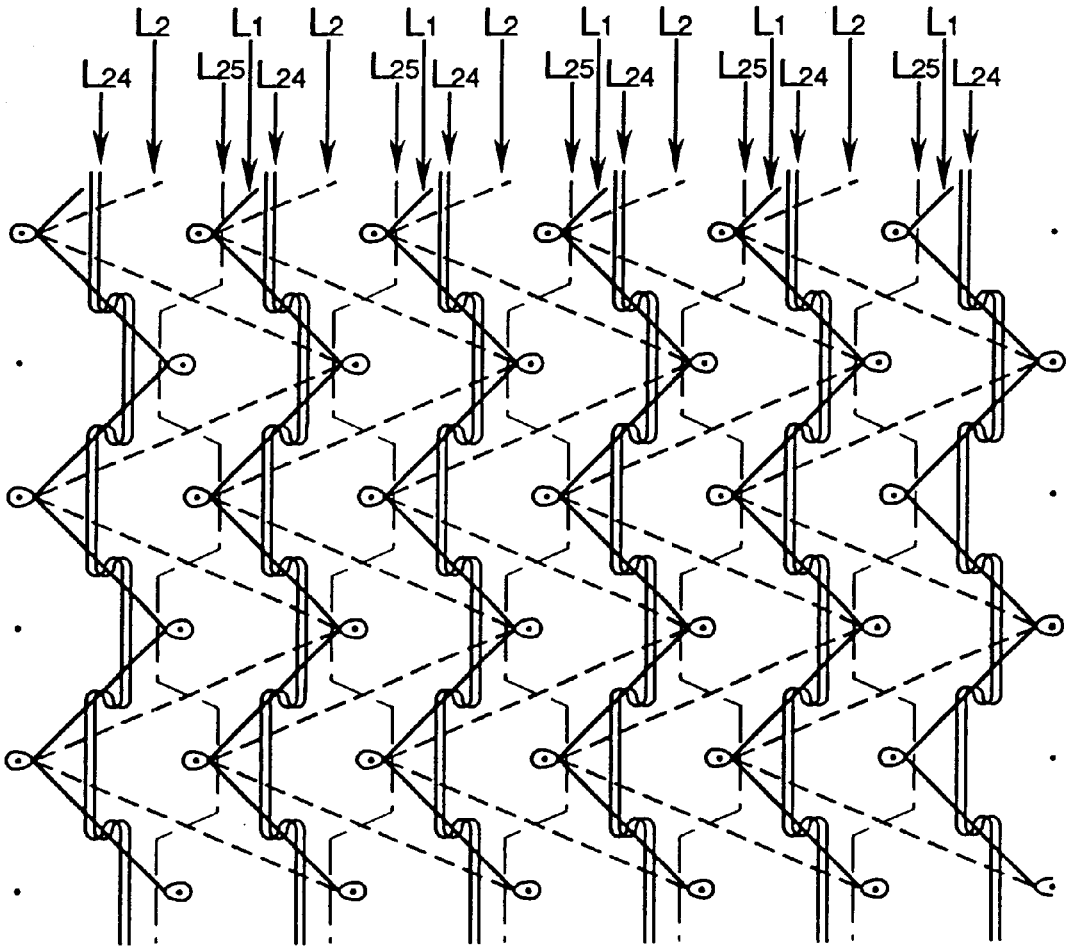
FIG. 6 shows the actual entanglement of yarns knitted according to the data in FIG. 5.
Figure 7:
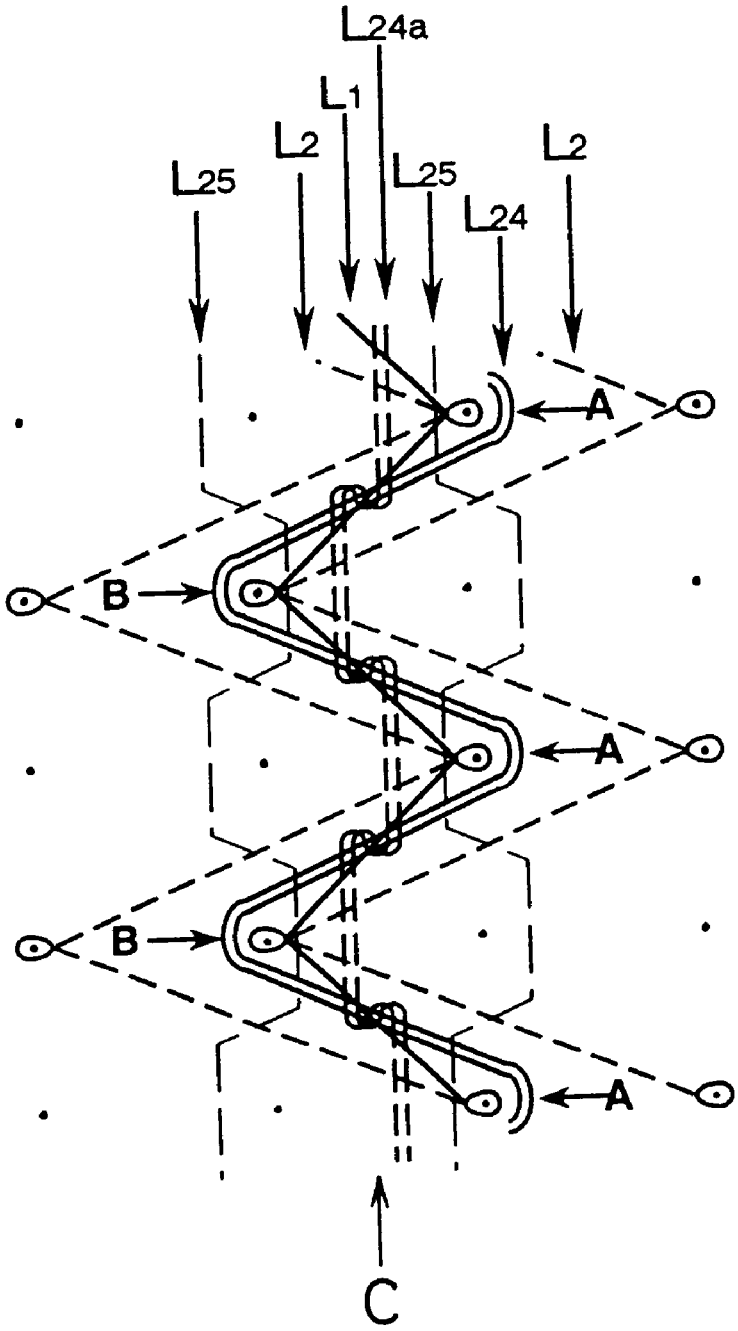
FIG. 7 schematically shows FIG. 6 simply.

FIGS. 5–7 show this embodiment. FIG. 5 schematically shows the knitting data of the fabric portion in the fourth embodiment; FIG. 6 shows the actual entanglement of yarns knitted according to the data in FIG. 5; and FIG. 7 schematically shows FIG. 6 simply.

$L_1$ moves by two needles to form the ground structure. $L_{24}$ moves outside the ground structure of $L_1$ in the same direction as $L_1$. Therefore, $L_{24}$ is knitted at the intermediate point C between points A and B at which $L_1$ is knitted so that $L_{24}$ is entangled with the yarn of the ground structure knitted with $L_1$ as shown by the dotted line $L_{24}$A without being knitted into the ground structure of $L_1$. $L_2$ moves by three needles. Therefore, the yarn of $L_{24}$ is not entangled with the ground structure knitted with $L_2$. The yarn of $L_{24}$ runs with the ground structure formed only of $L_2$. However, since the ground structure of $L_2$ is knitted simultaneously, the effect of lock stitch occurs. In addition, the yarn of $L_{24}$ can form a cylindrical shape at the point C where the yarn of $L_{24}$ is entangled with the yarn of $L_1$ by making the yarn of $L_{24}$ thicker than the yarn of $L_1$ or by using an elastic yarn as $L_{24}$ to provide tension. The cylindrical shape also can be seen as a stitch, so that the gauge can be seen as fine.

In the above, MRPJ25/1 manufactured by KARL MAYER was used as the knitting machine. In a commercial product of this knitting machine, three positive yarn feeders (EBA apparatuses) were provided. The knitting machine was improved by increasing the number of the EBA apparatuses to four, and the yarns were fed to the lace portion and the fabric portion by using the EBA apparatuses. More specifically, the fabric portion and the lace portion were uniformly knitted by using one EBA apparatus for each of $L_1$, $L_2$, $L_{24}$ and $L_{25}$, four EBA apparatuses in total.

Industrial Applicability

As described above, according to the present invention, the fabric portion and the lace portion are integrally knitted in the advance direction of stitches, so that the sewn portion between the fabric portion and the lace portion can be eliminated. Therefore, a warp knit fabric that is comfortable for wearing and is excellent in fashion and design without the protrusion of the seam line can be provided.

What is claimed is:

1. A seamless warp knit fabric for clothing, which is a raschel warp knit fabric comprising:

a fabric portion; and a lace portion, wherein the fabric portion and the lace portion are integrally knitted in a knitting direction so as to form one continuous warp knit fabric, and the fabric portion has a structure of chain stitch and lock stitch and is wider than the lace portion.

2. The seamless warp knit fabric according to claim 1, wherein the width of the fabric portion is at least three times the width of the lace portion.

3. The seamless warp knit fabric according to claim 1, wherein a plurality of the lace portions are formed in the knitting direction.

4. The seamless warp knit fabric according to claim 1, wherein the warp knit fabric is at least one knit fabric selected from the group consisting of a knit; fabric using inelastic yarns, a knit fabric using elastic yarns in one direction, and a knit fabric using elastic yams in two directions.

5. The seamless warp knit fabric according to claim 1, wherein a yarn of the fabric portion is a covered yarn in which an inelastic filament yarn is wound around an elastic filament yarn.

6. The seamless warp knit fabric according to claim 1, wherein the fabric portion is a knit fabric selected from the group consisting of a solid-colored knit fabric and a knit fabric having a solid-colored pattern.

7. The seamless warp knit fabric according to claim 1, wherein the fabric portion is a knit fabric selected from the group consisting of a single knitted structure and a double knitted structure.

8. The seamless warp knit fabric according to claim 1, wherein the lace portion is a knit fabric selected from the group consisting of a knit fabric forming a pattern and a knit fabric forming a narrow lace portion.

9. The seamless warp knit fabric according to claim 1, wherein an end of the seamless warp knit fabric is formed by drawing a yarn from a knitted structure in at least one boundary between the lace portion and the fabric portion adjacent to the lace portion.

10. The seamless warp knit fabric according to claim 1, wherein the area weight of the fabric portion, which is, is different from the area weight of the lace portion.

11. A method for producing a seamless warp knit fabric for clothing, using a raschel machine, comprising the following steps of:

preparing at least four positive yarn feeders to feed yarns to the knitting machine;

feeding yarns sent from at least two of the positive yam feeders to a jacquard while feeding yams sent from at least two of the positive yarn feeders to the knitting portion having chain stitch and lock stitch; and integrally knitting the fabric portion having chain stitch and lock stitch with a lace portion in a knitting direction so as to form one continuous warp knit fabric, the fabric portion being wider than the lace portion.

12. The method according to claim 11, wherein the width of the fabric portion is at least three times the width of the lace portion.

13. The method according to claim 11, wherein a plurality of the lace portions are formed in the knitting direction.

14. The method according to claim 11, wherein the warp knit fabric is at least one knit fabric selected from the group consisting of a knit fabric using inelastic yarns, a knit fabric using elastic yams in one direction, and a knit fabric using elastic yams in two directions.

15. The method according to claim 11, wherein a yarn of the fabric portion is a covered yarn in which an inelastic filament yarn is wound around an elastic filament yarn.

16. The method according to claim 11, wherein the fabric portion is a knit fabric selected from the group consisting of a solid-colored knit fabric and a knit fabric having a solid-colored pattern.

17. The method according to claim 11, wherein the fabric portion is a knit fabric selected from the group consisting of a single knitted structure and a double knitted structure.

18. The method according to claim 11, wherein the lace portion is a knit fabric selected from the group consisting of a knit fabric forming a pattern and a knit fabric forming a narrow lace portion.

19. The method according to claim 11, wherein Trend of the seamless warp knit fabric is formed by drawing a yarn from a knitted structure in at least one boundary between the lace portion and the fabric portion adjacent to the lace portion.

20. The method according to claim 11, wherein the unit area weight of the fabric portion, which is the basis weight, is different from the unit area weight of the lace portion.

21. Clothing comprising a seamless warp knit fabric of raschel warp knit fabric, wherein the warp knit fabric comprises a fabric portion and a lace portion that are integrally knitted in a knitting direction to form one continuous warp knit fabric, and the fabric portion has a structure of chain stitch and lock stitch and is wider than the lace portion.

22. Clothing according to claim 21, wherein the seamless warp knit fabric is at least one knit fabric selected from the group consisting of a knit fabric using inelastic yarns, a knit fabric using elastic yams in one direction, and a knit fabric using elastic yarns in two directions.

23. Clothing according to claim 21, wherein the clothing is selected from the group consisting of a shirt, a lingerie and a negligee.

24. Clothing according to claim 21, wherein there is no sewn portion between the fabric portion and the lace portion.

25. Clothing according to claim 21, wherein the fabric portion is a seamless knit fabric selected from the group consisting of a solid-colored knit fabric and a knit fabric having a solid-colored pattern.

26. Clothing according to claim 21, wherein the lace portion is a seamless knit fabric selected from the group consisting of a knit fabric forming a pattern and a knit fabric forming a narrow lace portion.

27. A device for producing a seamless knit fabric for clothing, comprising:

a jacquard, a knitting portion for forming a chain stitch and a lock stitch; and at least four positive yarn feeders, two for feeding yarn to the jacquard and two for feeding yarn to the knitting portion;

wherein the device is controlled to knit a fabric portion having chain stitch and lock stitch with a lace portion integrally in a knitting direction so as to form one continuous warp knit fabric, the fabric portion being wider than the lace portion.

28. The device according to claim 27, wherein at least two positive yam feeders for feeding yams are further provided as an elastic yarn feeder to provide stretching property to the fabric portion and the lace portion.

29. The fabric according to claim 1, having a width of at least 35 cm.

* * * * *